US006189433B1

(12) United States Patent
Harada

(10) Patent No.: US 6,189,433 B1
(45) Date of Patent: Feb. 20, 2001

(54) PNEUMATICALLY DRIVEN BELLOWS PUMP

(75) Inventor: Takashi Harada, Osaka (JP)

(73) Assignee: Tacmina Corporation, Osaka (JP)

( * ) Notice: Under 35 U.S.C. 154(b), the term of this patent shall be extended for 0 days.

(21) Appl. No.: 09/210,582

(22) Filed: Dec. 14, 1998

(30) Foreign Application Priority Data

May 13, 1998 (JP) ..... 10-130510

(51) Int. Cl.[7] ..... F01B 19/00
(52) U.S. Cl. ..... 92/34
(58) Field of Search ..... 92/34, 35, 42

(56) References Cited

U.S. PATENT DOCUMENTS 398,525 * 2/1889 McCloskey ..... 92/34
1,484,140 * 2/1924 Mallory ..... 92/42
2,781,565 * 2/1957 Atchison ..... 92/34 X
3,099,189 * 7/1963 Blondiau ..... 92/34 X
5,195,878 * 3/1993 Sahiavo et al. ..... 92/34 X
5,377,950 * 1/1995 Salcudean et al. ..... 92/34 X

* cited by examiner

*Primary Examiner*—John E. Ryznic
(74) *Attorney, Agent, or Firm*—Arent Fox Kintner Plotkin & Kahn, PLLC

(57) ABSTRACT

A pneumatically driven bellows pump includes a bellows that is reciprocable by a driving force effected by air. The bellows has an integral form of a bellows body, an expansion portion and a mounting portion. The mounting portion includes a threaded member, through which the bellows is brought into threaded engagement with a threaded member formed in a pump-driving member in such a manner as to seal the bellows.

6 Claims, 7 Drawing Sheets

PNEUMATICALLY DRIVEN BELLOWS PUMP

BACKGROUND OF THE INVENTION

1. Field of the Invention

The present invention relates to an improvement in a pneumatically driven bellows pump with a bellows that is reciprocable by a pneumatic force.

2. Discussion of the Background

Conventionally, the pump of the type or a reciprocable pump includes a cylinder 51 and cylinder heads 52 arranged at the opposite ends of the cylinder 51, as illustrated in FIG. 8. Outside of the cylinder 51 are provided a plurality of slide cylinders 53 which interconnect the cylinder heads 52 of the opposite ends of the cylinder 51 together. Interlocking shafts 54 are respectively inserted into the slide cylinders 53, each being secured at its opposite ends to interconnecting plates 55 via mounting bolts 56.

A pair of pistons 57 are oppositely disposed within the cylinder 51, which respectively include pump shafts 59 that are reciprocable along the longitudinal axis of the pump and with regard to shafts 58 extending inwardly from the central portions of the corresponding interconnecting plates 55, and shaft plates 60 mounted to corresponding ends of the pump shafts 59. The pistons 57 are respectively supported by bellows bodies 63 whose outer ends are respectively mounted to corresponding shaft plates 60 via mounting bolts 61, and inner ends are respectively welded to a pump-driving member 62. The pistons 57 are reciprocable along the longitudinal axis of the pump by the expansion and contraction of the bellows bodies 63. An air chamber 64 for allowing the bellows bodies 63 to be reciprocated therein is formed by the cylinder 51, the cylinder heads 52 and the shaft plates 60.

A sensor (not shown) senses the stroke end of the bellows in order to allow the switching of the introduction of the airflow for the air chamber 64. Whereby, fluids or the like can be discharged from the pump-driving member 62 via reciprocation of the pistons 57. Valves 65 are respectively urged by springs 66 so that the oppositely positioned bellows within the pump can be communicated with each other.

In accordance with the pump of the above arrangement, the bellows bodies 63 which limit the reciprocation of the pistons 57 seal the spaces inside of the bellows by the arrangement that the inner ends of the bellows bodies 63 are welded to the pump-driving member 62. Referring to FIG. 9, as an alternative to this arrangement, the bellows bodies 63 whose outer ends of the bellows bodies 63 are respectively mounted to the shaft plates 67 are held at their inner ends between pump-driving member 68 and spacers 69, and fixed therebetween via bolts 70, as illustrated in FIG. 9, in which the arrangement only for one of the bellows bodies 63 are illustrated, since the arrangement for another bellows body 63 is the same as that for the one bellows body 63.

When parts such as the bellows bodies 63 are damaged in the pump of the above arrangement, it may not easy to replace them with new ones since the replacement of these parts involves a troublesome work due to the above arrangement. Thus, the pump having the above arrangement may be in trouble with its maintenance.

To avoid such trouble, it is conceivable to employ the arrangement that the bellows bodies 63 are mounted to the pump-driving member 62 by fastening screws or bolts. However, this arrangement also poses a problem that heat or vibration caused by the operation of the pump may loosen the screws or bolts, and subsequently cause clearances in the mounting portion of the bellows bodies. This may lead to leakage of the fluid, and deteriorate a sealing effect within the bellows bodies 63. Therefore, this arrangement does not provide an essential solution for the above problem.

Therefore, the present invention has been conceived to solve the above problems. It is an object of the present invention to provide a pneumatically driven bellows pump with the arrangement that has ease of maintenance of the pump by replacing the bellows in a simple manner.

SUMMARY OF THE INVENTION

According to the present invention, there is provided a pneumatically driven bellows pump including a bellows that is reciprocable by a driving force effected by air. The bellows has an integral form of a bellows body, an expansion portion and a mounting portion. The mounting portion includes a threaded member, through which the bellows is brought into threaded engagement with a threaded member formed in a pump-driving member in such a manner as to seal the bellows.

In case of, for example, wear and tear, and breakage, with the pump of the above arrangement, the bellows can easily be replaced by releasing the mounting portion from threaded engagement with the pump-driving member.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Embodiment 1

Figure 1:
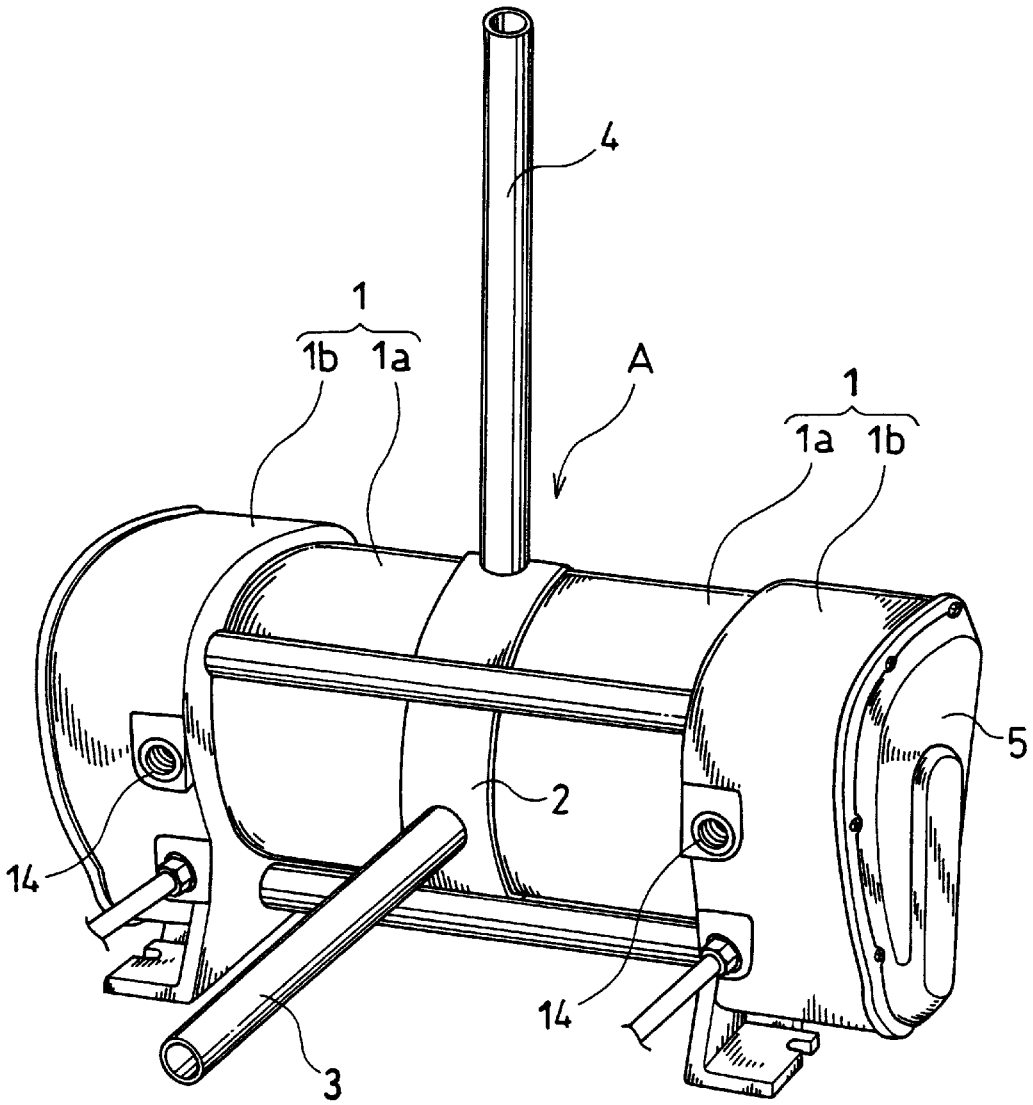
FIG. 1 is a perspective view illustrating an exterior appearance of a pneumatically driven bellows pump in accordance with the present invention.

Referring to FIG. 1, a reference numeral A denotes a pneumatically driven bellows pump. The pump A includes an external housing 1 which, in turn, includes a cylindrical portion la and dish-shaped ends 1*b* which are respectively mounted to the opposite ends of the cylindrical portion 1*a*. At the center of the housing 1 is provided a pump-driving member 2, to which an inlet pipe 3 and an outlet pipe 4 are connected. Fluids or the like are sucked via the inlet pipe 3 into the pump-driving member 2, in which the pressure of the fluids is increased. The pressurized fluids are then discharged from the outlet pipe 4. Protective covers 5 are respectively mounted to the outer portions of the dish-shaped ends 1*b* of the external housing cover in order to cover the same.

Figure 2:
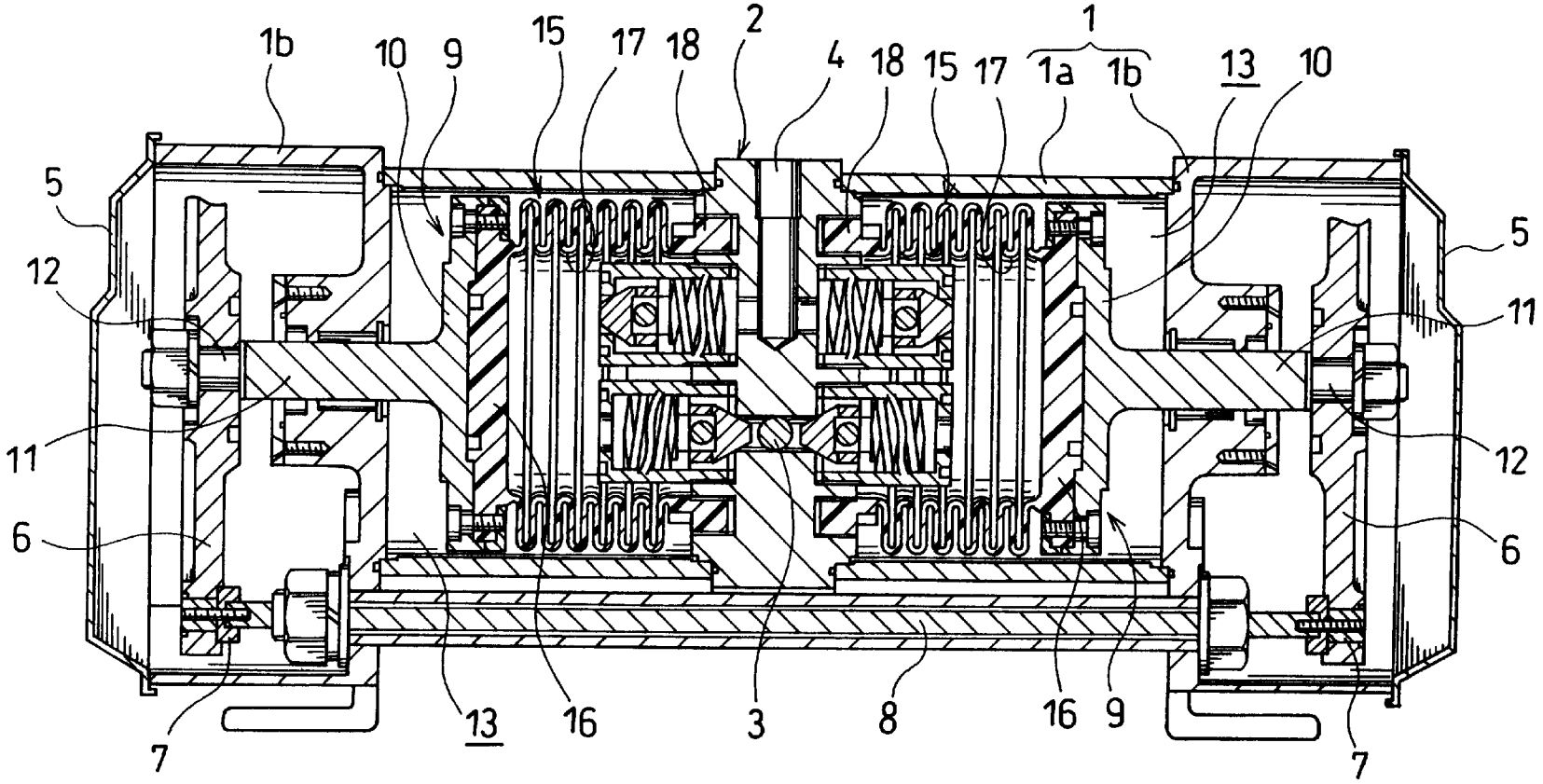
FIG. 2 is a side view with a partial cross section in accordance with one embodiment of the present invention.

Referring to FIG. 2, circular supporting plates 6 are respectively secured to the dish-shaped ends 1*b*. Both plates 6 are connected together via a plurality of supporting shafts 8, which are mounted to the housing 1 via mounting members 7.

A pair of piston members 9 are oppositely disposed within the housing 1 along the longitudinal axis of the pump in such a manner as to face each other. The piston members 9 respectively include cylindrical members 11 which, in turn, respectively have circular plates 10 at their inner ends. The cylindrical members 11 are respectively fitted on supporting shafts 12 which extend inwardly respectively from the center portions of the corresponding supporting plates 6 in such a manner as to be reciprocable along the longitudinal axis of the pump A. The pistons 9 of this arrangement therefore constitute within the housing 1 an air chamber 13 as a sealed space, into which air is supplied via air supplying pipes 14 as illustrated in FIG. 1.

Figure 3:
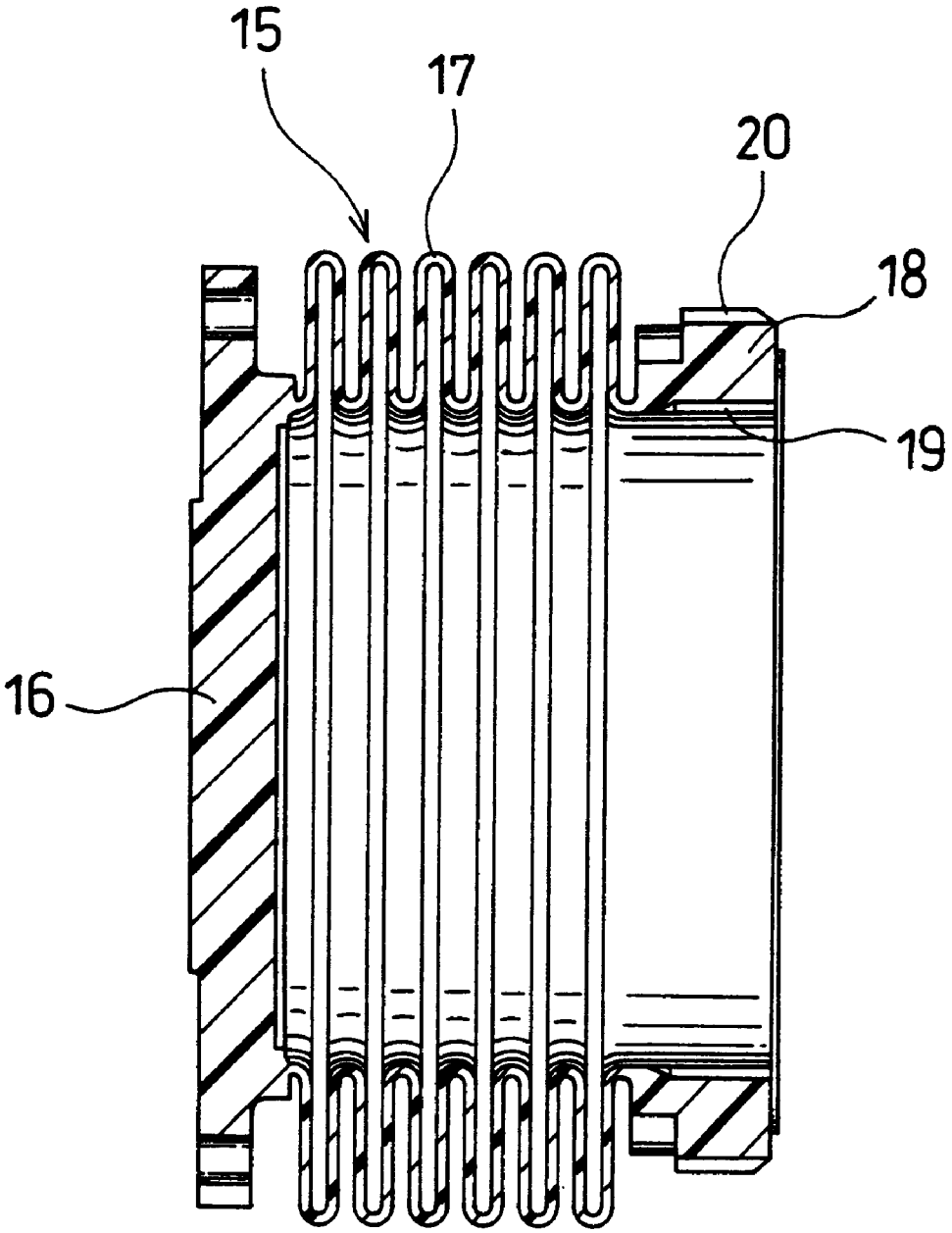
FIG. 3 is a cross sectional view of a bellows of FIG. 2.

A pair of bellows 15 are disposed between the circular plates 10 and the pump-driving member 2 in such a manner as to be reciprocable by the force effected by air. Referring to FIG. 3, each bellows 15 includes a bellows body 16, an expansion portion 17 and a mounting portion 18 for mounting the bellows 15 to the pump-driving member 2. Each bellows 15 has an integral form constituted by the bellows body 16, the expansion portion 17 and the mounting portion 18. Each mounting portion 18 includes a threaded member which, in turn, includes an inwardly threaded portion 19 and an outwardly threaded portion 20, which are respectively formed in an inner periphery and an outer periphery of each mounting portion 18. The inwardly threaded portion 19 has the same pitch as that of the outwardly threaded portion 20.

The pump-driving member 2 includes a threaded member in the form of a circular groove which, in turn, includes an inwardly threaded portion and an outwardly threaded portion respectively formed in an outer periphery and outer periphery of the threaded member of the member 2. Both threaded portions of the pump-driving member 2 respectively have the same pitch as that of the corresponding threaded portions of the mounting portion 18 of the bellows. Thereby, the mounting portion 18 can be brought into threaded engagement with the threaded member formed in the pump-driving member 2. Each bellows can be sealed and any leakage of the fluids from the inside of the bellows 15 can be prevented by threaded engagement between the mounting portion 18 and the pump-driving member 2.

Figure 4:
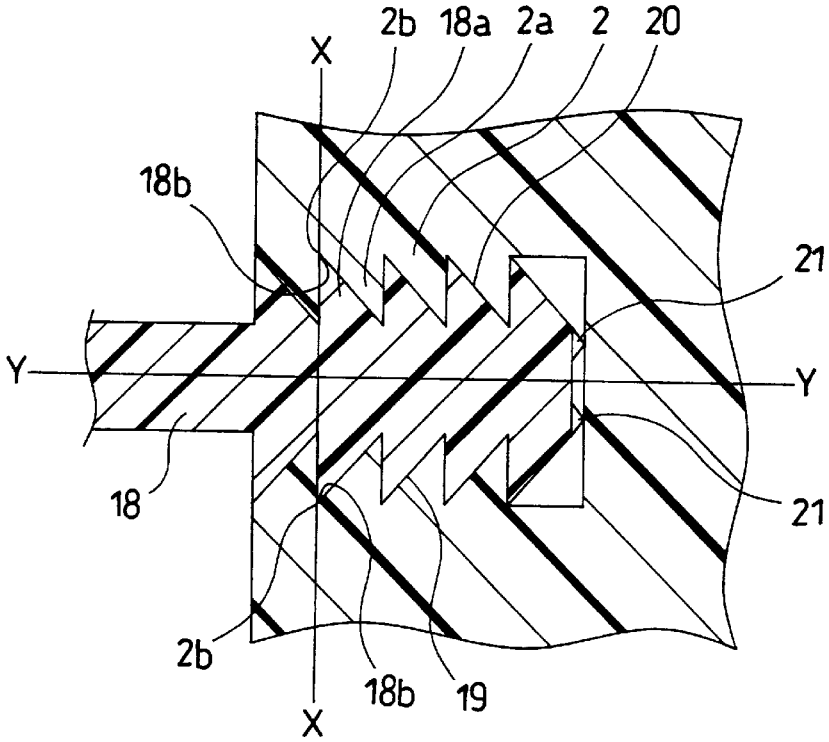
FIG. 4 is a cross sectional view illustrating a mounting state of a bellows.

Referring to FIG. 4, the threaded member of the mounting portion 18 has a modified buttress thread form. Accordingly, the threaded member of the pump-driving member 2 has a form corresponding to the threaded member of the mounting portion 18 having the modified buttress thread form in such a manner as to be brought into threaded engagement with the threaded member of the mounting portion 18. By this form, the resistance force effected by a load flank of each thread 18*a* of the mounting portion 18 and a corresponding load flank of each thread 2*a* of the threaded member of the pump-driving member 2 can be increased so that the mounting portion 18 is unlikely to be loosened within the threaded member of the pump-driving member. This increases a sealing effect. A pair of ridges 18*b* of the inwardly threaded portion 19 and the outwardly threaded portion 20 for each thread 18*a* and 2*a* lie on the same plane taken along the line of X—X as that of a pair of the valleys 2*b*, on the same axial line Y—Y of the mounting portion 18.

To increase the sealing effect, circular projections 21 are formed on a leading end of the mounting portion 18 in this embodiment. By tightening the mounting portion 18 into the threaded member of the pump-driving member 2, the circular projections 21 are pressed against a wall of the threaded member of the pump-driving member 2.

In this embodiment, a plurality of circular projections 21 are employed. However, it is a matter of course to form a single circular projection on the leading end of the mounting portion 18.

Figure 5:
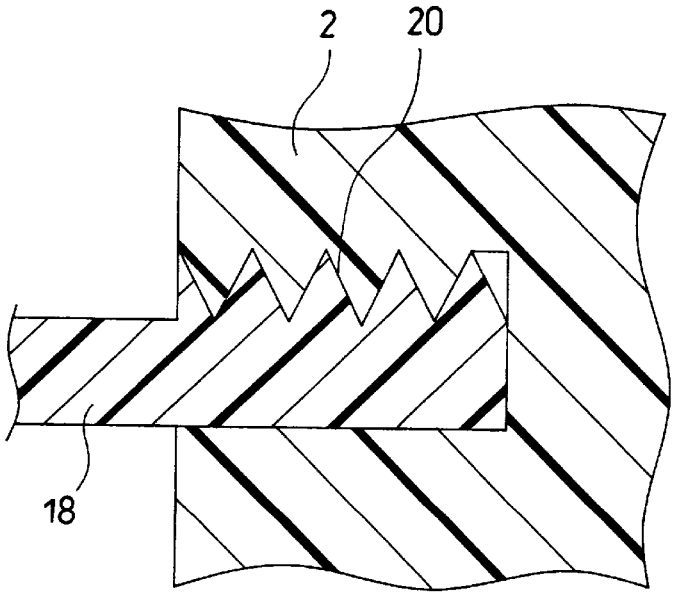
FIG. 5 is a cross sectional view illustrating a mounting portion of a bellows in accordance with another embodiment.

In this embodiment, the modified buttress thread form is employed. However, this is not an essential. FIG. 5 illustrates the mounting portion having the threaded member of a different form. The profile of the threads is a well-known type. This arrangement may omit the inwardly threaded portion.

According to this embodiment, each bellows 15 is tightly secured to the pump-driving member 2 via the threaded engagement between the threaded members of the mounting portion 18 and the pump-driving member 2. With this arrangement, a desirable sealing condition can be maintained within the bellows bodies 16, thereby preventing the fluids from leaking out of the bellows bodies 16, even if heat and vibration have been caused by the reciprocal motion of the bellows 16 by the force of air. During the operation of the pump A, the temperature and pressure within the cylinder 51 are increased to expand the threaded portions of the mounting portion 18, thereby increasing the sealing area. Thus, the sealing force can be improved.

In addition to the above effect, the pump A has ease of maintenance. Specifically, in case of, for example, wear and tear, and breakage of the bellows 15, the bellows 15 can easily be replaced with a new one by releasing the mounting portion 18 of each bellows 15 to be replaced from the threaded engagement with the pump-driving member 2.

Figure 6:
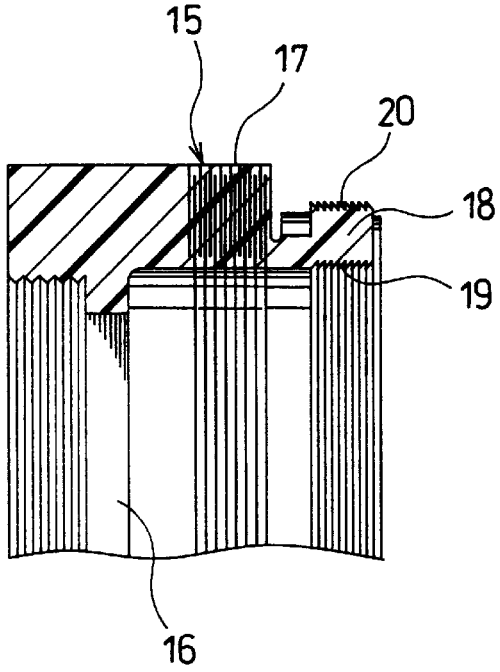
FIG. 6 is a cross sectional view of a bellows in accordance with another embodiment illustrating a contracting state of a bellows body.
Figure 7:
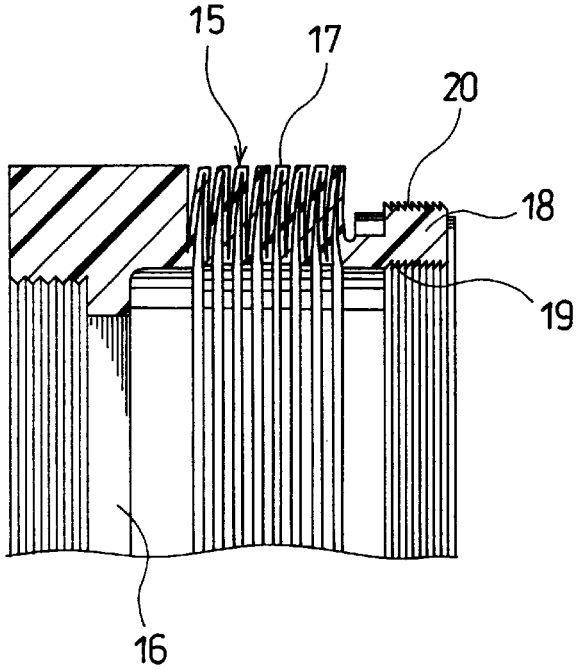
FIG. 7 is a cross sectional view of a bellows of FIG. 6 in an expanding state.
Figure 8:
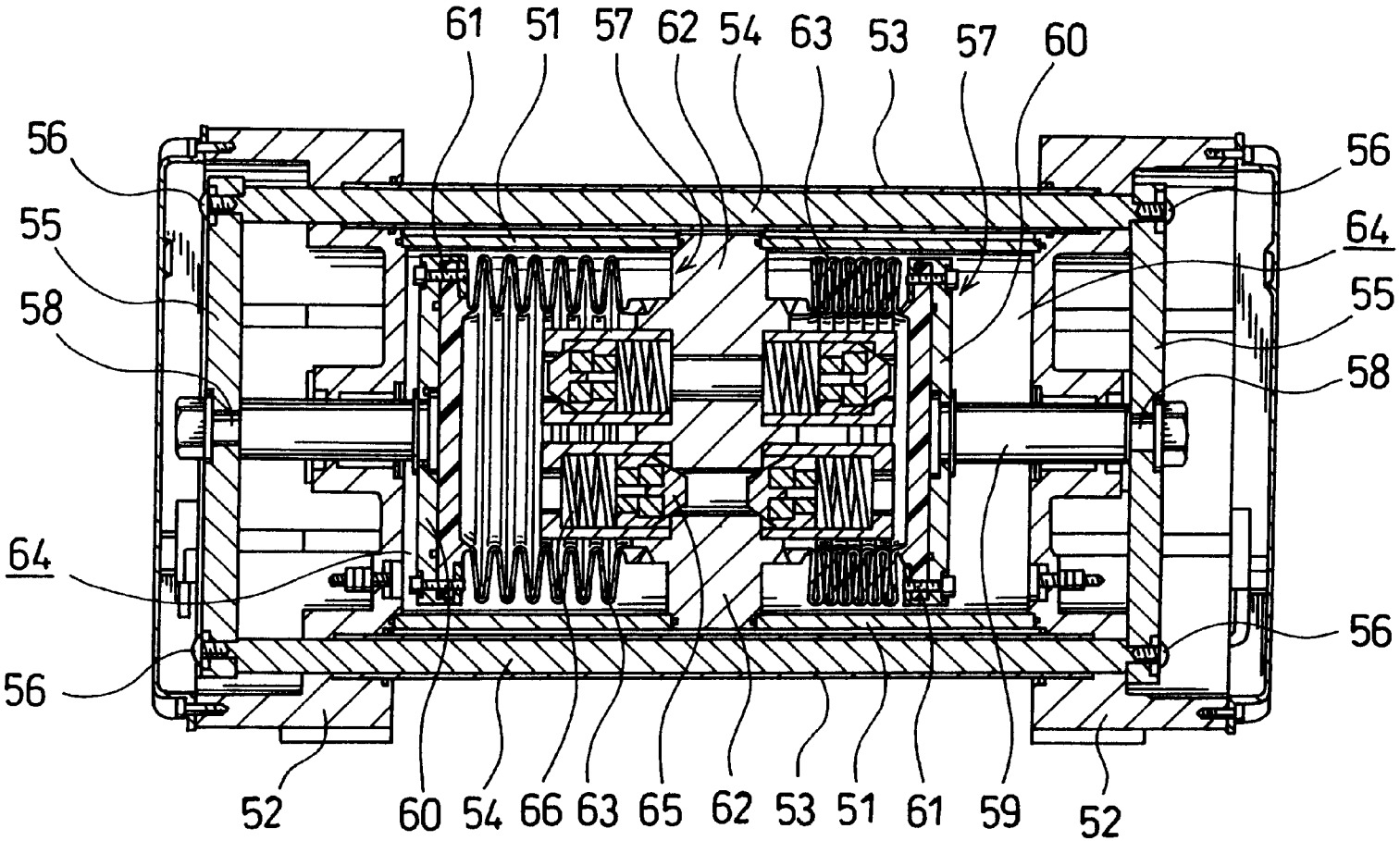
FIG. 8 PRIOR ART
FIG. 8 is a side view with a partial cross section illustrating a conventional pump.
Figure 9:
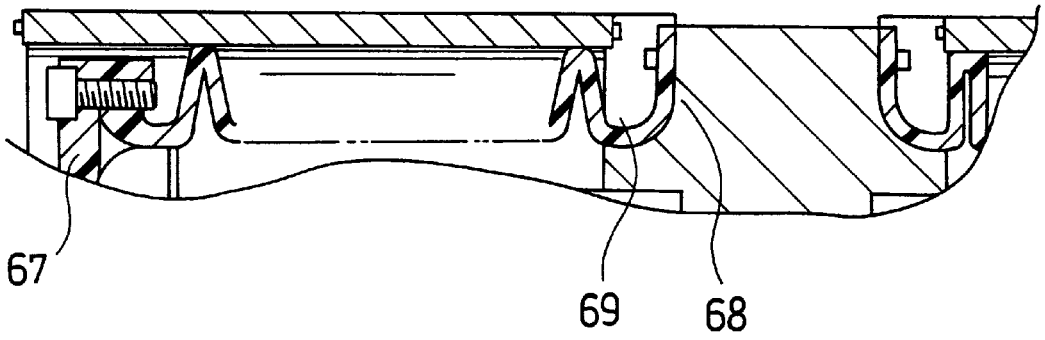
FIG. 9 PRIOR ART
FIG. 9 illustrates a mounting state of a bellows of the conventional pump.

FIGS. 6 and 7 respectively illustrate the contracting and expanding states of the bellows 15 in accordance with another embodiment, in which the expansion portion 17 is formed by alternately cutting the outer and inner peripheries of the mounting portion 17.

The expansion portion 17 of FIGS. 3 and 6A may be formed by various materials, for example, rubber, resilient plastic and other resilient materials, and metal, rigid plastic and other rigid materials.

Each bellows 15 may preferably be made of polytetrafluoroethylene and formed by integrally molding the mounting portion 18, the bellows body 16 and the expansion portion 17. The polytetrafluoroethylene made bellows increase its anticorrosion property. The material of each bellows 15, however, can be varied. Even in this arrangement, each bellows 15 has an integral form constituted by the bellows body 16, the expansion portion 17 and the mounting portion 18, so that the same function and effect as those mentioned above can be produced.

This specification is by no means intended to restrict the present invention to the preferred embodiments set forth therein. Various modifications to the pneumatically driven solenoid pump of the present invention, as described herein, may be made by those skilled in the art without departing from the spirit and scope of the present invention as defined in the appended claims.

What is claimed is:

1. A pneumatically driven bellows pump comprising a bellows reciprocable by a driving force effected by air, said bellows having an integral form constituted by a bellows body, an expansion portion and a mounting portion, said mounting portion having an annular shape with an inner peripheral surface and an outer peripheral surface respectively forming an inwardly threaded portion and an outwardly threaded portion, a pump-driving member to which said bellows is mounted, said pump-driving member forming an annular groove with an inwardly threaded portion and an outwardly threaded portion, to which said inwardly threaded portion and said outwardly threaded portion of said mounting portion are brought into threaded engagement, thereby mounting said bellows to said pump-driving member in such a manner as to form a sealed space within said bellows.

2. A pneumatically driven bellows pump as set forth in claim 1, wherein the bellows is made of polytetrafluoroethylene.

3. A pneumatically driven bellows pump as set forth in claim 1, wherein at least one circular projection is formed on a leading end of the mounting portion which is pressed against an annular bottom wall of the annular groove of the pump-driving member at the time that the mounting portion has been brought into engagement with the annular groove formed in the pump-driving member.

4. A pneumatically driven bellows pump as set forth in claim 1, wherein each of said inwardly threaded portion and said outwardly threaded portion of the mounting portion has a buttress thread form, and said inwardly threaded portion and said outwardly threaded portion of the pump-driving member respectively have forms corresponding to said outwardly threaded portion and said inwardly threaded portion of the mounting portion.

5. A pneumatically driven bellows pump as set forth in claim 4, wherein a pair of ridges of said inwardly threaded portion and said outwardly threaded portion of said mounting portion for each thread lie on the same plane taken along the of X—X as that of a pair of valleys, on the same axial line Y—Y of said mounting portion.

6. A pneumatically driven bellows pump as set forth in claim 1, wherein said mounting portion has a wall thickness greater than said expansion portion, and said outwardly threaded portion of said bellows having a threaded portion and a non-threaded portion, said non-threaded portion being located axially outwardly of said annular groove of said pump-driving member when said bellows have been mounted to said pump-driving member through threaded engagement of said mounting portion and said annular groove.

* * * * *